US009844793B2

(12) United States Patent
Michelfelder et al.

(10) Patent No.: US 9,844,793 B2
(45) Date of Patent: Dec. 19, 2017

(54) ATOMIZER AND METHOD FOR APPLYING ONE-AND MULTI-COMPONENT COATING AGENTS

(75) Inventors: Manfred Michelfelder, Höpfigheim/Steinheim (DE); Bernhard Seiz, Lauffen (DE); Frank Herre, Oberriexingen (DE)

(73) Assignee: Durr Systems GmbH, Bietigheim-Bissingen (DE)

( * ) Notice: Subject to any disclaimer, the term of this patent is extended or adjusted under 35 U.S.C. 154(b) by 457 days.

(21) Appl. No.: 13/582,344

(22) PCT Filed: Mar. 2, 2011

(86) PCT No.: PCT/EP2011/001039
§ 371 (c)(1),
(2), (4) Date: Nov. 14, 2012

(87) PCT Pub. No.: WO2011/107275
PCT Pub. Date: Sep. 9, 2011

(65) Prior Publication Data

US 2013/0108796 A1 May 2, 2013

(30) Foreign Application Priority Data

Mar. 3, 2010 (DE) ..... 10 2010 010 053

(51) Int. Cl.
*B05B 12/14* (2006.01)

(52) U.S. Cl.
CPC ..... *B05B 12/14* (2013.01); *B05B 12/1418* (2013.01)

(58) Field of Classification Search
CPC ..... B05B 12/14; B05B 12/1418
USPC ..... 239/106, 112, 398, 583, 589, 74; 427/421.1, 426
See application file for complete search history.

(56) References Cited

U.S. PATENT DOCUMENTS 3,848,802 A 11/1974 Degginger et al.
4,703,894 A * 11/1987 Fukuta ..... B29B 7/7447 239/414
5,225,239 A 7/1993 Ostin
5,727,735 A 3/1998 Baumann et al.
2002/0023971 A1* 2/2002 Ochiai ..... B05B 3/1014 239/223
2005/0074562 A1 4/2005 Minko
(Continued)

FOREIGN PATENT DOCUMENTS

DE 19543548 A1 5/1997
DE 29719535 U1 3/1998
(Continued)

OTHER PUBLICATIONS

International Search Report, PCT/EP2011/001039, dated May 6, 2011.
(Continued)

*Primary Examiner* — Alexander Weddle
(74) *Attorney, Agent, or Firm* — Bejin Bieneman PLC

(57) ABSTRACT

An atomizer for coating, for example automobile bodies, add-on parts and/or truck cabs is provided. The atomizer may be configured to apply one multi-component coating agent and one single-component coating agent from one application element, or to apply two different multi-component coating agents from one application element.

7 Claims, 1 Drawing Sheet

(56) References Cited

U.S. PATENT DOCUMENTS

| | | | | |
|---|---|---|---|---|
| 2009/0158998 | A1* | 6/2009 | Herre | 118/300 |
| 2009/0277378 | A1* | 11/2009 | Yamauchi | B05B 3/10 118/300 |
| 2010/0133353 | A1* | 6/2010 | Herre | B05B 12/1409 239/1 |
| 2011/0014371 | A1* | 1/2011 | Herre et al. | 427/236 |
| 2011/0076411 | A1 | 3/2011 | Nussbaum | |

FOREIGN PATENT DOCUMENTS

| | | | | |
|---|---|---|---|---|
| DE | 10047838 | A1 | 4/2002 | |
| DE | 10358646 | A1 | 7/2005 | |
| DE | 102004038017 | A1 | 3/2006 | |
| EP | 1644130 | B1 | 2/2007 | |
| EP | 2076336 | B1 | 4/2010 | |
| JP | 2001276687 | A | 10/2001 | |
| JP | 2002210396 | A | 7/2002 | |
| JP | 2005246167 | A | 9/2005 | |
| JP | 2006043490 | A | 2/2006 | |
| WO | WO-8912509 | A1 | 12/1989 | |
| WO | WO-2005044466 | A2 | 5/2005 | |
| WO | WO 2005044466 | A2 * | 5/2005 | |
| WO | WO 2008058650 | A2 * | 5/2008 | B05B 12/1409 |
| WO | WO2008058650 | A2 | 5/2008 | |
| WO | WO 2009115201 | A2 * | 9/2009 | |

OTHER PUBLICATIONS

Notification of Reasons for Rejection from the Japan Patent Office for JP Application No. 2012555334 dated Jan. 6, 2015 (7 pages; with English translation).

* cited by examiner

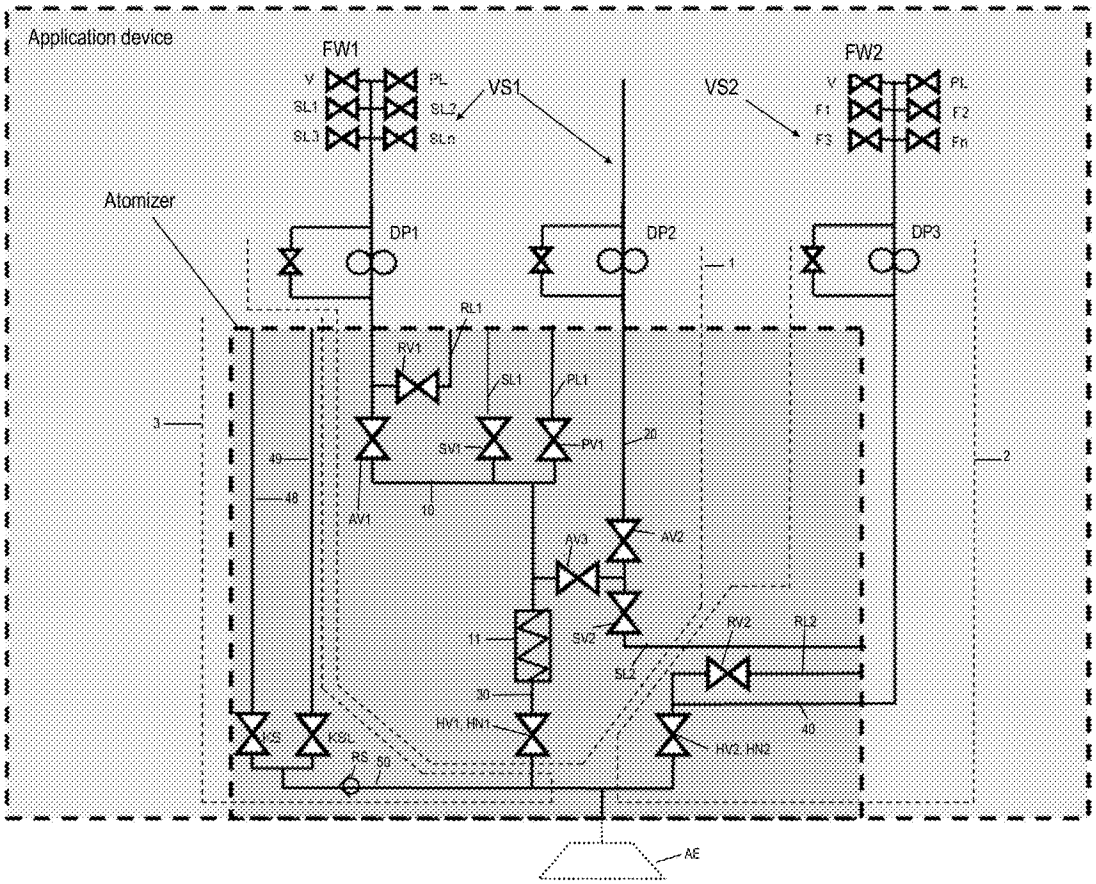
Application device
Atomizer
FW1
FW2
VS1
VS2
DP1
DP2
DP3
AE

ATOMIZER AND METHOD FOR APPLYING ONE-AND MULTI-COMPONENT COATING AGENTS

CROSS-REFERENCES TO RELATED APPLICATIONS

This application is a National Stage application which claims the benefit of International Application No. PCT/EP2011/001039 filed Mar. 2, 2011, which claims priority based on German Application No. DE 10 2010 010 053.6, filed Mar. 3, 2010, both of which are hereby incorporated by reference in their entireties.

BACKGROUND

The present disclosure refers to an atomizer, e.g., a rotary atomizer, and a method for applying a single-component coating agent (e.g. a single-component paint) and a multi-component coating agent (e.g. a multi-component paint) or two different multi-component coating agents (e.g. two different two-component paints), e.g., to car bodies, their attachment parts, truck cabins and/or their attachment parts.

During surface coating of car bodies a number of paint layers are usually applied in successive painting zones using different atomizers specific for the respective paint layer. For example, two painting zones are needed for painting trucks. A single-component metallic paint is applied in the first zone and then a two-component clear coat is applied in the second zone. However, this mode of operation only applies to a very small percentage of the bodies to be coated. The largest part of the bodies to be coated are, for example, coated with a Uni-paint (a single-coat base paint) which does not require any clear coat to be applied afterwards. Thus the second painting zone in which the two-component clear coat is applied is only seldom used and used to capacity, but is still necessary to have.

The disadvantage with this arrangement is, in particular, the division into a number of painting zones and painting cabins and the associated need for additional painting robots each with a different paint-specific application technology. Furthermore the maintenance and servicing required is more extensive due to the different paint-specific application equipment being used.

WO 2008/058650 A2, US 2009/0277378 A1, US 2005/0074562 A1, U.S. Pat. No. 5,727,735 A, U.S. Pat. No. 5,225,239 A, DE 297 19 535 U1 and DE 103 58 646 A1 disclose further technological background information.

There is a need to solve or overcome the above described problems or disadvantages. The present disclosure thus relates to this requirement of the prior art and to other requirements.

BRIEF DESCRIPTION OF THE FIGURES

While the claims are not limited to the specific illustrations described herein, an appreciation of various aspects is best gained through a discussion of various examples thereof. Referring now to the drawings, illustrative examples are shown in detail. Although the drawings represent the exemplary illustrations, the drawings are not necessarily to scale and certain features may be exaggerated to better illustrate and explain an innovative aspect of an illustration. Further, the exemplary illustrations described herein are not intended to be exhaustive or otherwise limiting or restricting to the precise form and configuration shown in the drawings and disclosed in the following detailed description. Exemplary illustrations are described in detail by referring to the drawings as follows:

The figure shows an application device and, in particular, an atomizer for series coating of car bodies, attachment parts and/or truck cabins. The atomizer shown in the figure is provided in order to optionally apply a single-component coating agent and a multi-component coating agent.

DETAILED DESCRIPTION

The objects arising from the aforementioned can be achieved in principle with the features of the independent claims. The exemplary illustrations are not limited, however, to examples that remedy all of the problems or disadvantages of the prior art cited at the outset.

According to the exemplary illustrations, an atomizer (for example a rotary atomizer) may be provided, e.g., for series coating, for example of car bodies and/or truck cabins and/or (their) attachment parts.

The atomizer is provided in order (optionally) to apply a multi-component coating agent and a single-component coating agent from an application element. Furthermore, the atomizer can be provided in order (optionally) to apply two different multi-component coating agents from an application element.

Application of the multi-component coating agent and a single-component coating agent can occur one after the other. In a similar way application of two different two multi-component coating agents can occur one after the other. The multi-component coating agent comprises at least one coating component (for example base paint) and at least one hardener component.

One advantageous aspect of an exemplary atomizer is, in particular, that the required application equipment can be reduced, above all the required number of robots and the required number of zones. Furthermore, an exemplary atomizer leads to reduced maintenance and servicing due to the identical nature of the components involved and allows a so-called box concept to be used with which, for example, a vehicle can be completely and fully automatically painted in one station, in particular without a change of atomizer.

The multi-component coating agent may be led from a first equipment to the application element and applied by the application element, whereas, for example, the single-component coating agent is led by a second equipment to the application element and applied by the application element. The atomizer can, therefore, comprise a first equipment, which is provided in order to lead the multi-component coating agent to the application element. Furthermore, the atomizer can comprise a second equipment, which is provided in order to lead the single-component coating agent to the application element. The first equipment can, in particular, be supplied by a first supply string (e.g., comprising a paint changing arrangement, a metering device for the coating agent component and a metering device for the hardener component) with a changeable coating agent and/or rinsing agent and/or pulsed air and/or hardener, whereas the second equipment can be supplied by a second supply string (for example, comprising a paint changing arrangement and a metering device for the single-component-coating agent) with a changeable coating agent and/or rinsing agent and/or pulsed air. The first supply string (together with its paint changing arrangement and metering device(s)) and the second supply string (together with its paint changing arrangement and metering device) may be arranged separated from each other.

It may be advantageous that the first supply string is connected to or is connectable with the first equipment, whereas the second supply string is connected to or is connectable with the second equipment.

For exemples where the atomizer is provided to apply two different multi-component coating agents from an application element, the various multi-component coating agents may be led from two first equipments arranged separated from each other to the application element and applied by the application element. It is therefore possible that the atomizer comprises two first equipments, which are provided in order to feed two different multi-component coating agents to the application element. For this example, the atomizer may therefore be fitted with two first equipments instead of a first equipment and a second equipment. In particular, the one first equipment and the other first equipment are supplied by separately arranged supply strings (which each may comprise a paint changing arrangement, a metering device for the coating agent component and a metering device for the hardener component) with a changeable coating agent and/or rinsing agent and/or pulsed air and/or hardener. The two separately arranged first equipments and/or their respective supply string may be essentially identically constructed.

Thus the atomizer may comprise at least one first equipment which is provided in order to lead the multi-component coating agent to the application element.

The paint changing arrangements can, for example, be conventional paint changers (for example valve blocks) or also docking paint changers and the metering devices can, for example, be conventional metering pumps.

The single-component coating agent may be a single-component paint (for example a base paint). The two-component coating agent may be a two-component paint (for a two-component clear coat and/or a two-component base paint). Multi-component coating agents are coating agents which have at least one coating agent component and at least one hardener component. The multi-component coating agents can have various base paint systems (for example wet paints, such as solvent paints or water-based paints). The multi-component coating agent can be a conventional multi-component coating agent, in particular a conventional two-component paint, which is usually used to coat car bodies, attachment parts and/or truck cabins.

The concept of an "atomizer" used within the context of the exemplary illustrations should be interpreted in general terms and comprises, for example, rotary atomizers in the form of bell or disc atomizers, as well as ultrasonic, air, airless or Airmix devices. Correspondingly, within the scope of the exemplary illustrations, the application element may be a bell plate, a rotary disc or simply a nozzle.

Furthermore, the atomizer can comprise a third equipment, e.g., a nozzle, for short flushing of the application elements with a rinsing agent and/or to apply air (or pulsed air) to the application element, in particular the nozzle.

The first equipment, the second equipment and/or the third equipment can be arranged separated from each other. The first equipment, the second equipment and/or the third equipment can, for example, be arranged in parallel.

Furthermore, for examples with two first equipments (for example the one first equipment and the other first equipment), the two first equipments and the third equipment can be arranged separated from each other. The two first equipments may be, for example, arranged parallel to each other and parallel to the third equipment.

In a similar way, the supply strings supplying the equipments and/or the paint changer and metering devices can be arranged separated from each other, in parallel to each other.

It is possible that the atomizer, in particular at least a first equipment, is provided in such a way that at least the parts, which come into contact with the coating agent component and the hardener component can be flushed out and/or impinged with pulsed air. The rinsing agent and/or the pulsed air may be ejected together with the coating agent/hardener residues from the application element in a collecting device. Unintended hardening of the coating agent component and the hardener component in an atomizer would damage the atomizer and possibly even destroy it.

In one exemplary illustration, the atomizer (or at least a first equipment) comprises a feed line for the coating agent component and a feed line for the hardener component, which may be arranged separated from each other and, in particular, parallel to each other. The atomizer (or at least a first equipment) can be fitted with a mixing element, which is supplied with the coating agent component and the hardener component, wherein the coating agent component and the hardener component are mixed. Furthermore, the atomizer (or at least a first equipment) can be fitted with a manifold line, which is provided to receive the coating agent component and the hardener component and which may, for example, come from the mixing element and are fed to the application element. The atomizer (or at least a first equipment) furthermore may be fitted with a first main needle for the multi-component coating agent. The first main needle (or a first main needle valve) can be provided on or in the manifold line, in particular between the mixing element and the application element and can, in particular, be supplied by a first paint changing arrangement (e.g. with a multi-component coating agent, rinsing agent and pulsed air).

In order to accommodate the mixing element also in spatially limited sections in the atomizer, the mixing element must have correspondingly small dimensions and nevertheless achieve sufficient mixing results, which conventional mixers are incapable of doing. One mixing element suitable for the exemplary illustrations could, for example, be manufactured using a generative method (for example rapid prototyping, for example laser sintering, laser melting, etc.).

The feed line for the coating agent component can be connected with a return line, e.g., one fitted with a stop valve for the coating agent component. Furthermore, the feed line for the coating agent component can comprise a stop valve for the coating agent component. The feed line for the coating agent component can be connected with a flushing line, e.g., one fitted with a flushing valve, which is provided to at least flush out the feed line for the coating agent component in sections in order to flush out the mixing element, and/or to flush out the manifold line. Furthermore, the feed line for the coating agent component can be connected with a pulsed air line, e.g., one fitted with a pulsed air valve, to at least apply pulsed air to the feed line for the coating agent component in sections in order to apply pulsed air to the mixing element, and/or to apply pulsed air to the manifold line. The rinsing agent and/or the pulsed air may be ejected together with the coating agent/hardener residues from the application element into a collecting device.

The feed line for the hardener component can discharge upstream before the mixing element into the feed line for the coating agent component. It is, however, possible that the feed line for the hardener component and the feed line for the coating agent component discharges immediately into the mixing element. The feed line for the hardener component can be fitted with a first stop valve for the hardener component and/or a second stop valve for the hardener component. Furthermore, the feed line for the hardener agent component can be connected with a flushing line, e.g., one fitted with a flushing valve, which is provided to at least flush out the feed line for the hardener agent component in sections in order to flush out the mixing element, and/or to flush out the manifold line.

The flushing line and/or the pulsed air line connected with the feed line for the coating agent component can discharge between the stop valve for the coating agent component and the mixing element into the feed line for the coating agent component. The flushing line connected with the feed line for the hardener agent component can discharge between the first stop valve for the hardener component and the second stop valve for the hardener component into the feed line for the hardener component.

The return line for the coating agent component may be connected upstream in front of the stop valve for the coating agent component with the feed line for the coating agent component. Furthermore, the mixing element can be provided downstream behind the stop valve for the coating agent component and/or the flushing valve (the flushing line, which is connected with the feed line for the coating agent component) and/or the pulsed air valve. Furthermore, the first stop valve for the hardener component may be provided upstream in front of the second stop valve for the hardener component, wherein, furthermore, the mixing element can, for example, be provided downstream behind the second stop valve for the hardener component. Furthermore, the first main needle can be provided downstream behind the mixing element and/or lead the collection line of the mixing element through the first main needle to the application element.

The atomizer (or the second equipment) can be fitted with a feed line for the single-component coating agent and/or a second main needle (or a second main needle valve) for the single-component coating agent which, for example, may be arranged on or in the feed line for the single-component coating agent and, in particular, can be supplied by a second paint changing arrangement (e.g. with a single-component-coating agent, rinsing agent and pulsed air).

It is possible that the multi-component coating agent is led by the first supply string and/or the first equipment through the first main needle or the first main needle valve to the application element, wherein the single-component coating agent can be led from the second supply string and/or the second equipment through the second main needle or the second main needle valve to the application element.

It is possible that the feed line for the single-component coating agent is connected with a return line, such as one fitted with a stop valve for the single-component coating agent. The return line may be connected upstream in front of the second main needle with the feed line for the single-component coating agent.

The return line for the coating agent component and/or the return line for the single-component coating agent can be directly connected to one or more collecting devices, which significantly simplifies disposal of waste. Furthermore, the return line for the coating agent component and/or the return line for the single-component coating agent allows permanent circulation of the coating agent component and/or the single-component coating agent. One further important point for use of return lines in the different areas is the time saved by at least partially parallel processes, e.g. flushing between the paint changer and the atomizer (dependent upon the type of charging and paint used).

The atomizer (or the third equipment) can be fitted with a feed line for rinsing agent and/or pulsed air. In this case the feed line for rinsing agent and/or pulsed air can, for example, lead downstream behind the first main needle and/or the second main needle essentially directly to the application element. The third equipment is provided in particular for short flushing out of the application element.

The feed line for the rinsing agent and/or air, e.g., pulsed air, on the third equipment can be supplied by a feed line for rinsing agent which is, in particular, fitted with a flushing valve and/or by a feed line for air which is, in particular, fitted with an air valve, e.g., pulsed air.

It is possible that the third equipment, in particular its feed line for rinsing agent and/or air, such as pulsed air, comprises a valve, e.g., a stop valve, which is in particular provided in order to prevent a return flow or through flow, for example of single-component coating agent, of multi-component coating agent, of rinsing agent and/or of pulsed air. This valve can, for example, be arranged downstream behind the flushing valve or the air valve. Furthermore, this valve can, for example, be assigned downstream behind the first main needle or the first main needle valve and/or the second main needle or the second main needle valve. A return flow of a fluid (for example of single-component coating agent, of multi-component coating agent, of rinsing agent and/or of pulsed air) from the at least one first equipment or second equipment can, in particular, be prevented, that is advantageously of a fluid, which may have passed the first main needle or the first main needle valve and/or the second main needle or the second main needle valve.

The first main needle can be provided on a first main needle valve and the second main needle can be provided on a second main needle valve. As an alternative it is possible that the first main needle and the second main needle are provided on a common main needle valve. Furthermore it is possible that the first main needle valve and the second main needle valve are connected with the application element. As an alternative it is possible that the common main needle valve is connected with the application element. In particular the first main needle is assigned to the first equipment and therefore has multi-component coating agent applied to it, while the second main needle is assigned to the second equipment and is therefore impinged with single-component coating agent.

Furthermore, the atomizer may, for example, have an equipment to monitor and/or set the first main needle valve or the second main needle valve or a an equipment to monitor and/or set the common main needle valve.

At least a first equipment (or a feed line for the coating agent component) can be coupled to a first paint changing arrangement in order to supply the feed line for the coating agent component with a changeable coating agent, rinsing agent and/or pulsed air. Furthermore, at least a first equipment (or a feed line for the coating agent component) can be coupled to a first metering device, such as a metering pump, which is provided to meter the coating agent component and which, for example, is provided downstream behind the first paint changing arrangement and/or upstream before the stop valve for the coating agent component and/or the stop valve for the coating agent component. Furthermore, at least a first equipment (or a feed line for hardener component) can be coupled to a second metering device, e.g., a metering pump, which is provided in order to meter the hardener component and which can be provided, for example, upstream before the second stop valve. There may be, for example, at least one first equipment provided, which leads the multi-component coating agent to a first main needle valve. The first paint changing arrangement and the first and second metering devices can be assigned to a first supply string.

The second equipment (or the feed line for the single-component coating agent) can be coupled to a second paint changing arrangement in order to supply the feed line for the single-component coating agent with a changeable coating agent and/or rinsing agent and/or pulsed air. Furthermore, the second equipment (or the feed line for the single-component coating agent) can be connected to a third metering device, such as a metering pump, which is provided in order to meter the single-component coating agent and which can, for example, be fitted downstream behind the second paint changing arrangement and/or upstream before the second main needle and/or the second stop valve. The second equipment may be provided in order to lead the single-component coating agent to the second main needle valve. The second paint changing arrangement and the third metering pump can therefore be assigned to a second supply line which is provided separately from the first supply string.

The respective paint changing arrangements and the respective metering devices can be provided in, on or at a distance from or outside the atomizer.

According to the exemplary illustration there may, furthermore, be an application device such as a painting machine or a painting robot provided with an atomizer as described above. The exemplary illustrations thus not only comprise the atomizer described above in the form of a single component, but also a complete painting machine fitted with such an atomizer, wherein the painting machine may be in the form of a multiple-axis painting robot, side painting machine or roof machine. However, the exemplary illustrations are not restricted to painting robots, roof machines or side painting machines, but also comprises other types of machine.

The painting machine can be embodied as a multiple-axis painting robot and have a first robot arm ("arm 1") and a second robot arm ("arm 2"), wherein the second robot arm is attached to be movable to the first robot arm and may have a direct robot wrist fitted with an application device (e.g. a rotary atomizer). The above-mentioned metering pumps of the respective supply strings may be fitted on or in the first robot arm ("arm 1"), for example. There is an alternative possibility within the scope of the examplary illustrations for the individual metering pumps to be fitted on or in the second robot arm ("arm 2").

Any painting robot may be used that is convenient, for example, as described in WO 2009/115201 and/or corresponding U.S. Pat. Pub. No. US020110014371A1 so that the contents of WO 2009/115201 and U.S. Pat. Pub. No. US020110014371A1 are each hereby expressly incorporated by reference in their entireties.

There is also a possibility that one of the metering pumps be fitted on or in the first robot arm, whilst another metering pump is fitted to the second robot arm.

For example, the painting machine may have an axis of travel with a carriage which can be moved along a rail, where the carriage bears a painting robot, for example. The metering pumps may then be wholly or partly arranged to travel on the carriage.

It is furthermore possible that the first metering device and/or the second metering device and/or the third metering device is fully or partially integrated into the atomizer. However, the exemplary illustrations are not restricted to the above examples in respect of the spatial arrangement of the metering pumps, but may also be implemented in another way.

The exemplary illustrations also comprise a painting cabin with an inventive painting machine and a cabin wall, which spatially restricts the painting cabin. The above-mentioned metering pumps may be arranged wholly or partly on the cabin wall, either inside the paint cabin or outside the paint cabin.

According to another exemplary illustration, there is furthermore a method provided, in particular, for example, for coating car bodies, their attachment parts, truck cabins, which is performed using an atomizer as described above or an application device as described above. The method comprises the following steps: (optional) application of a multi-component coating agent and a single-component coating agent from an application element; or (optional) application of a second different multi-component coating agent from an application element.

Application of the multi-component coating agent and a single-component coating agent can occur one after the other. In a similar way application of two different two multi-component coating agents can occur one after the other.

The multi-component coating agent may be led from a first equipment to the application element and applied by the application element, wherein the single-component coating agent may be led to a second equipment to the application element and applied by the application element.

For the example where two different multi-component coating agents are applied from an application element, the two different multi-component coating agents may be led by two first equipments arranged separated from each other to the two first main needles and/or to the application element and applied by the application element.

The first equipment, in particular its feed line for the coating agent component, be supplied with a changeable coating agent, rinsing agent and/or pulsed air from a first paint changing arrangement, wherein the second equipment, in particular its feed line for the single-component coating agent, can be supplied with a changeable coating agent, rinsing agent and/or pulsed air from a second paint changing arrangement. The first paint changing arrangement in this case can be assigned to the first supply string (which in turn can be, for example, fitted with a metering device for the coating agent component and/or a metering device for the hardener component), whereas the second paint changing arrangement can be assigned to the second supply string (which in turn can be, for example, fitted with a metering device for the single-component coating agent).

At least one first equipment (that is one first equipment or two first equipments) can at least execute the following steps: Feeding of a coating agent component through a feed line for the coating agent component to a mixing element; feeding of a hardener component through a feed line for the hardener component to a mixing element; mixing of the coating agent component and the hardener component in the mixing element; feeding of the mixed multi-component coating agent to the application element, in particular from a first supply string through a first main needle.

A second equipment can lead the single-component coating agent, in particular by means of the feed line for the single-component coating agent, e.g., through a second main needle, to the application element.

Furthermore, the method can at least comprise one of the following steps (which may be executed by at least a first equipment): flushing of a section of the feed line for the single-component coating agent by means of a return line for the coating agent component, wherein the section is arranged upstream before a stop valve for the coating agent component; flushing and/or application of pulsed air to the mixing element, the first main needle valve and/or a section of the feed line for the coating agent component, wherein the section is arranged upstream before the stop valve for the coating agent component; flushing of a section of the feed line for the hardener component, wherein the section is arranged downstream behind a first stop valve for the hardener component and opens out into the feed line for the coating agent component or the mixing element.

Furthermore, the method can at least comprise one of the following steps: by means of the second equipment, for example, flushing of a section of the feed line for the single-component coating agent through a return line for the single-component coating agent, wherein the second is arranged upstream before the second main needle valve; short flushing and/or application of pulsed air to the application element, in particular a nozzle of the application element, by means of a third equipment; ejection of the rinsing agent and/or the pulsed air out of the application element and/or the return lines in a collecting device, wherein the rinsing agent and/or the pulsed air, which were led through the return lines, are not ejected through the application element.

The rinsing agent can comprise a cleaning agent and/or a solvent (e.g. thinner). Furthermore, the rinsing agent can comprise a blocking agent, which at least delays hardening of the multi-component coating agent, and in one example may essentially prevent it. All monofunctional molecules, which can react with at least one component of the multi-component coating agent come into consideration as the blocking agent. The blocking agent may comprise amines, alcohols, low alcohol concentrations, ethanol, propanol and/or its isomers, and/or butanol and/or its isomers. The blocking agent can also comprise a reactive substance such as a retarding agent, e.g., organic acid chlorides. The hardener component of the multi-component coating agent can, for example, be isocyanate.

The atomizer is, in one exemplary illustration, a rotary atomizer which is fitted with a bell plate acting as an application element AE in order to apply a multi-component coating agent (comprising a coating agent component (base paint) and a hardener component) and the single-component coating agent to car bodies, attachment parts and truck cabins. The multi-component coating agent is a two-component paint (e.g. 2K clear paint or 2K base paint), wherein the single-component coating agent is a single-component paint (e.g. base paint).

Reference numeral 1 marks a first equipment, which is provided in order to lead the multi-component coating agent mixed to the application element AE. Reference numeral 2 marks a second equipment, which is provided in order to lead the single-component coating agent to the application element AE. Reference numeral 3 marks a third equipment, which is provided in order to shortly flush out and/or to apply pulsed air to the application element AE.

The first equipment 1, the second equipment 2 and the third equipment 3 are provided separated from each other, in particular arranged in parallel to each other, and each lead to the application element AE.

The first equipment 1 has a feed line 10 for the coating agent component and a feed line 20 for the hardener component, which may be arranged in parallel to each other, and a mixing element 11 for mixing the coating agent component and the hardener component. Furthermore, the first equipment 1 is fitted with a manifold line 30, which is provided to receive the coating agent component and the hardener component which leave the mixing element 11 and are led through a first main needle valve HV1, fitted with a first main needle, to the application element AE.

The multi-component coating agent is made available by means of a first supply string VS1 which is fitted with a first paint changing arrangement FW1 (paint changer), a first metering device DP1 for metering the coating agent component, a hardener reservoir (not shown) and a second metering device DP2 for metering the hardener component. A rinsing agent and pulsed air can also be made available through the first paint changer FW1. The first paint changer FW1 and the first metering device DP1 are assigned to the feed line 10 for the coating agent component or can be coupled with them, wherein the hardener reservoir and the second metering device DP2 of the feed line 20 are assigned to the hardener component or can be coupled with them.

The single-component coating agent is made available by means of a second supply string VS2, which is fitted with a second paint changing arrangement FW2 (paint changer) and a third metering device DP3 for metering the single-component coating agent. A rinsing agent and pulsed air can also be made available through the second paint changer FW2. The second paint changer FW2 and the third metering device DP3 are assigned to or can be coupled with a feed line 40 for the single-component coating agent.

Therefore, the first supply string VS1 is connected to or is connectable with the first equipment 1, whereas the second supply string VS2 is connected to or is connectable with the second equipment 2.

The feed line 10 is connected for the coating agent component with return RL1 fitted with a return valve RV1 for the coating agent component and comprises a stop valve AV 1. Furthermore, the feed line 10 for the coating agent component is connected with a flushing line SL1 fitted with a flushing valve SV1. The flushing line SL1 is arranged in order to flush out the feed line 10 for the coating agent component, at least section by section, downstream behind the stop valve AV1, and in order to flush out the mixing element 11 as well as the manifold line 30. Furthermore, the feed line 10 for the coating agent component is connected with a pulsed air line PL1 fitted with a pulsed air valve PV1, which is provided to at least section by section apply pulsed air to the air line downstream behind the stop valve AV1 to the feed line 10 for the coating agent component and in order to apply pulsed air to the mixing element 11 as well as the manifold line 30.

The feed line 20 for the hardener component discharges upstream shortly before the mixing element 11 into the feed line 10 for the coating agent component. The feed line 20 for the hardener component is fitted with a first stop valve AV2 for the hardener component and a second stop valve AV3 for the hardener component. Furthermore, the feed line 20 for the hardener component is connected with a flushing line SL2 fitted with a flushing valve SV2, which is provided to at least section by section flush out the feed line 20 for the hardener component and in order to flush out the mixing element 11 as well as the manifold line 30.

The rinsing agent which is fed in through the first flushing line SL1 and the second flushing line SL2, as well as the pulsed air which fed in through the pulsed air line PL1, are ejected through the application element AE into a collecting device (not shown).

The flushing line SL1 and the pulsed air line PL1 connected with the feed line 10 for the coating agent component discharge between the stop valve AV1 for the coating agent component and the mixing element 11 into the feed line 10 for the coating agent component, wherein the flushing line SL2 connected with the feed line 20 for the hardener component discharges between the first stop valve AV2 for the hardener component and the second stop valve AV3 for the hardener component into the feed line 20 for the hardener component.

The return line RL1 for the coating agent component is connected upstream before the stop valve AV 1 with the feed line 10 for the coating agent component. The mixing element 11 is provided arranged downstream behind the stop valve AV1 for the coating agent component, behind the flushing valve SV1 in the first flushing line SL and behind the pulsed air valve PV1 in the pulsed air line PL1. The first stop valve AV2 for the hardener component is provided upstream before the second stop valve AV3 for the hardener component, wherein the mixing element 11 is in turn provided downstream behind the second stop valve AV3 for the hardener component.

The first main needle valve HV1 fitted with a main needle HN1 is made available downstream behind the mixing element 11. The manifold line 30 guides mixed multi-component coating agent through the first main needle valve HV1 fitted with a main needle HN1 to the application element AE.

The second equipment 2 is made available with the feed line 40 for the single-component coating agent and a second main needle valve HV2 fitted with a main needle HN2. The feed line 40 for the single-component coating agent is connected with a return line RL2 fitted with a stop valve RV2 for the single-component coating agent. The feed line 40 for the single-component coating agent leads through the second main needle valve HV2 to the application element AE.

The third equipment 3 has a feed line 50 for the rinsing agent and/or pulsed air, which leads to the application element AE. The third equipment 3 is provided to shortly flush out the application element AE, wherein the rinsing agent and the pulsed air from the application element AE are ejected into a collecting device. The feed line 50 is supplied with rinsing agent by a feed line 48 fitted with a valve KS and is supplied with air by a feed line 49 fitted with a valve KSL.

The feed line 50 also comprises a valve RS, which is designed as a stop valve. The valve RS is arranged downstream behind the valves KS and KSL and downstream behind the first main needle valve HV1 and the second main needle valve HV2. The valve RS is provided in order to prevent reverse flow of the single-component coating agent, the multi-component coating agent, the rinsing agent and/or of the pulsed air out of the first equipment 1 and the second equipment 2.

The atomizer shown in the figure is provided in order to apply a multi-component coating agent and a single-component coating agent from the application element AE.

However, the atomizer according to the exemplary illustration can also be designed to apply two different multi-component coating agents from an application element. For this purpose, the second equipment 2 shown in the figure can be replaced by a further first equipment 1. Thus, this atomizer comprises two essentially functionally identical first equipments separated from each other, for example arranged in parallel to each other, which can respectively lead a multi-component coating agent to the application element. According to this, the one first equipment and the other first equipment are supplied by separately arranged supply strings as described above (which each may comprise a first paint changing arrangement, a first metering device for the coating agent component and a second metering device for the hardener component) with a changeable coating agent and/or rinsing agent and/or pulsed air and/or hardener. Thus the one multi-component coating agent is led by a first supply string and/or a first equipment, in particular through a first main needle, to the application element, wherein the other multi-component coating agent is led by another supply string and/or another first equipment, in particular through a first main needle, to the application element. In this case the supply strings and the equipments are indeed separated from each other but are essentially designed functionally and/or constructionally identical. In particular, the supply strings and the equipments can be the same as the first supply string and/or the equipment described above. Otherwise, the atomizer, which is provided in order to apply two different multi-component coating agents from an application element is essentially identical to the atomizer described above, which is provided in order to apply a multi-component coating agent and a single-component coating agent from an application element, so that reference is made to the above description to avoid repetition.

The exemplary illustrations are not limited to the previously described examples. Rather, a plurality of variants and modifications are possible, which also make use of the ideas of the exemplary illustrations and therefore fall within the protective scope. Furthermore the exemplary illustrations also include other useful features, e.g., as described in the subject-matter of the dependent claims independently of the features of the other claims.

Reference in the specification to "one example," "an example," "one embodiment," or "an embodiment" means that a particular feature, structure, or characteristic described in connection with the example is included in at least one example. The phrase "in one example" in various places in the specification does not necessarily refer to the same example each time it appears.

With regard to the processes, systems, methods, heuristics, etc. described herein, it should be understood that, although the steps of such processes, etc. have been described as occurring according to a certain ordered sequence, such processes could be practiced with the described steps performed in an order other than the order described herein. It further should be understood that certain steps could be performed simultaneously, that other steps could be added, or that certain steps described herein could be omitted. In other words, the descriptions of processes herein are provided for the purpose of illustrating certain examples, and should in no way be construed so as to limit the claimed invention.

Accordingly, it is to be understood that the above description is intended to be illustrative and not restrictive. Many examples and applications other than those specifically provided would be evident upon reading the above description. The scope of the invention should be determined, not with reference to the above description, but should instead be determined with reference to the appended claims, along with the full scope of equivalents to which such claims are entitled. It is anticipated and intended that future developments will occur in the arts discussed herein, and that the disclosed systems and methods will be incorporated into such future examples. In sum, it should be understood that the invention is capable of modification and variation and is limited only by the following claims.

All terms used in the claims are intended to be given their broadest reasonable constructions and their ordinary meanings as understood by those skilled in the art unless an explicit indication to the contrary is made herein. In particular, use of the singular articles such as "a," "the," "the,"

etc. should be read to recite one or more of the indicated elements unless a claim recites an explicit limitation to the contrary.

LIST OF REFERENCE SIGNS

1 First equipment
2 Second equipment
3 Third equipment
10 Feed line for coating agent component
11 Mixer
20 Feed line for hardener component
30 Manifold line
40 Feed line for the single-component coating agent
51 Feed line for the rinsing agent for short flushing and/or pulsed air
AE Application element
AV 1 Stop valve for coating agent component
AV2 Stop valve for hardener component
AV3 Stop valve for hardener component
RL1 Return line for coating agent component
RV1 Return valve
RL2 Return line for single-component coating agent
RV2 Return valve
SL1 Flushing line
SV1 Flushing valve
SL2 Flushing line
SV2 Flushing valve
VS 1 Supply string
VS2 Supply string
FW1 Paint changing arrangement (paint changer)
FW2 Paint changing arrangement (paint changer)
DP1 Metering device (metering pump)
DP2 Metering device (metering pump)
DP3 Metering device (metering pump)
HN1 Main needle
HV1 Main needle valve
HN2 Main needle
HV2 Main needle valve
KS Valve
KSL Valve
PL1 Pulsed air line
RS Non-return valve

The invention claimed is:

1. An atomizer, comprising:

an application element that is configured to apply first and second coating agents;

a first equipment fluidly connected to the application element, the first equipment including a first coating agent component feed line, a hardener component feed line, an inline mixer which receives and mixes the first coating agent component with a hardener component; a manifold line connected to an output of the inline mixer and a first main needle connected to the manifold line; and a second equipment separate from the first equipment and fluidly connected to the application element, the second equipment including a single component coating agent feed line, a second main needle and a return valve proximate the second main needle valve.

2. The atomizer according to claim 1, wherein the first coating agent component feed line is connected with a return line fitted with a return valve for the first coating agent component;

includes a stop valve for the first coating agent component;

is connected with a flushing line fitted with a flushing valve, which is configured to flush out the first coating agent component feed line; flush out the mixer; and flush out the manifold line; and is connected with a pulsed air line fitted with a pulsed air valve, the pulsed air line configured to provide the first coating agent component feed line with pulsed air; in order to provide the manifold line with pulsed air; and in order to provide the mixer with pulsed air.

3. The atomizer according to claim 1, wherein the hardener component feed line discharges upstream of the mixer into the feed line for the first coating agent component, and the first coating agent component feed line-discharges into the inline mixer;

has a first stop valve for the hardener component;

has a second stop valve for the hardener component; and is connected with a flushing line fitted with a flushing valve, which is configured to flush out the feed line for the hardener component; flush out the mixer; and flush out the manifold line.

4. The atomizer according to claim 2, further comprising a hardener component feed line wherein at least one of the flushing line and the pulsed air line connected with the first coating agent component feed line discharges between the stop valve for the first coating agent component and the mixer into the first coating agent component feed line; and the flushing line connected to the hardener component feed line discharges between the first stop valve for the hardener component and the second stop valve for the hardener component into the hardener component feed line.

5. The atomizer according to claim 2, wherein the return line for the first coating agent component is connected upstream of the stop valve for the first coating agent component to the first coating agent component feed line;

the inline mixer is provided downstream of at least one of the stop valve for the first coating agent component, the flushing valve, and the pulsed air valve;

the first stop valve for the hardener component is provided upstream of the second stop valve for the hardener component;

the inline mixer is provided downstream of the second stop valve for the hardener component;

the first main needle is provided downstream of the mixer; and the manifold line leads from the mixer via the first main needle to the application element.

6. The atomizer according to claim 1, wherein at least one first equipment is coupled to a first paint changing arrangement that is configured to supply the first coating agent component feed line with at least one of a changeable coating agent, a rinsing agent, and pulsed air;

wherein the at least one first equipment is coupled to a first metering device configured to meter the first coating agent component;

wherein the at least one first equipment is coupled to a second metering device configured to meter the hardener component; and wherein the at least one first equipment is configured to feed the multi-component coating agent to the first main needle valve.

7. The atomizer according to claim 1, further comprising:

a common main needle valve, including a first main needle and a second main needle;

wherein the first main needle is configured to deliver the first coating agent and the second main needle is configured to deliver the second coating agent; and the common main needle valve is connected with the application element.

* * * * *